US008819886B1

(12) United States Patent
Boukair

(10) Patent No.: US 8,819,886 B1
(45) **Date of Patent: *Sep. 2, 2014**

(54) PAINT ROLLER

(76) Inventor: Moe Boukair, Redondo Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/550,602

(22) Filed: Jul. 17, 2012

Related U.S. Application Data

(63) Continuation-in-part of application No. 13/471,443, filed on May 14, 2012.

(51) Int. Cl.
*B05C 17/02* (2006.01)

(52) U.S. Cl.
USPC ..... 15/230.11; 15/143.1; 492/13; 492/19; D4/122

(58) Field of Classification Search
USPC ..... 15/143.1, 230.11; 492/13, 19; D4/122, D4/123
See application file for complete search history.

(56) References Cited

U.S. PATENT DOCUMENTS

| | | | | | |
|---|---|---|---|---|---|
| 2,994,899 | A | * | 8/1961 | Moilanen | 15/244.2 |
| 3,165,772 | A | * | 1/1965 | McGinley | 15/230.11 |
| 3,886,621 | A | * | 6/1975 | Welsh | 15/230.11 |
| 5,979,009 | A | * | 11/1999 | Polzin et al. | 15/230.11 |
| D574,153 | S | * | 8/2008 | Dehart | D4/122 |
| 2010/0024147 | A1 | * | 2/2010 | Watson | 15/230.11 |

FOREIGN PATENT DOCUMENTS

FR 2881970 * 8/2006

* cited by examiner

*Primary Examiner* — Mark Spisich
(74) *Attorney, Agent, or Firm* — Michael D. Eisenberg

(57) ABSTRACT

A paint roller, comprising: a handle; a roller head, having a bevel; and a neck. The bevel has a length that extends perpendicular to the circumference of the roller head. The neck connects the handle to the roller, and the neck comprises: a first leg connected to the handle; a first bend connected to the first leg having a first radius of curvature, redirecting the neck about 90 degrees from the first leg; a second bend redirecting the neck about 180 degrees from the first leg; a second leg connected to the second bend, the second leg shorter than the first leg; a third bend redirecting the neck about 90 degrees from the second leg; a third leg connected to the third bend, the third leg shorter than the second leg; a fourth bend redirecting the neck about 90 degrees from the third leg; and a fourth leg connected to the fourth bend, shorter than the third leg, the fourth leg connected to the roller head.

5 Claims, 11 Drawing Sheets

PAINT ROLLER

CROSS-REFERENCES TO RELATED APPLICATIONS

The present application is a continuation in part of U.S. application Ser. No. 13/471,443 filed on May 14, 2012 which is hereby incorporated herein by reference in its entirety.

TECHNICAL FIELD

The present invention, in some embodiments thereof, relates to paint rollers.

BACKGROUND OF THE INVENTION

The present invention addresses the need for an improved apparatus for painting walls near the junction between the wall and a ceiling or ornamental structure near the ceiling such as crown molding.

BRIEF SUMMARY OF EMBODIMENTS OF THE INVENTION

The present invention relates to a paint roller, comprising: a handle; a roller head; and a neck. The neck connects the handle to the roller, and the neck comprises: a first leg connected to the handle and protruding out from a top end of the handle; a first bend connected to the first leg having a first radius of curvature, redirecting the neck about 90 degrees from the first leg; a second bend having a second radius of curvature of about the same value as the first radius of curvature, redirecting the neck about 180 degrees from the first leg; a second leg connected to the second bend, the second leg shorter than the first leg; a third bend having a radius of curvature smaller than the first and second radii of curvature, redirecting the neck about 90 degrees from the second leg; a third leg connected to the third bend, the third leg shorter than the second leg; a fourth bend having a radius of curvature of about the same value as the third radius of curvature, redirecting the neck about 90 degrees from the third leg; and a fourth leg connected to the fourth bend, shorter than the third leg, the fourth leg connected to the roller head.

In a variant, the paint roller further comprises a rotatable connection between the neck and the roller head.

In another variant of the paint roller, a roller head further comprises a bevel, having a length in the range of 1/20 of an inch to 1 inch that extends perpendicular to the circumference of the roller head.

In a further variant of the paint roller, the first leg of the neck makes an angle to the second leg of the neck in the range of 5 to 25 degrees.

In still another variant of the paint roller, a roller head further comprises a bevel, having a length in the range of 1/20 of an inch to 1 inch that extends perpendicular to the circumference of the roller head, and the first leg of the neck makes an angle to the second leg of the neck in the range of 5 to 25 degrees.

In another variant, a paint roller, comprises: a handle; a roller head, having a bevel that comprises a length in the range of 1/20 of an inch to 1 inch that extends perpendicular to the circumference of the roller head, and a neck. The neck connects the handle to the roller, and the neck comprises: a first leg connected to the handle and protruding out from a top end of the handle; a first bend connected to the first leg having a first radius of curvature, redirecting the neck about 90 degrees from the first leg; a second bend having a second radius of curvature of about the same value as the first radius of curvature, redirecting the neck about 180 degrees from the first leg; a second leg connected to the second bend, the second leg shorter than the first leg; a third bend having a radius of curvature smaller than the first and second radii of curvature, redirecting the neck about 90 degrees from the second leg; a third leg connected to the third bend, the third leg shorter than the second leg; a fourth bend having a radius of curvature of about the same value as the third radius of curvature, redirecting the neck about 90 degrees from the third leg; and a fourth leg connected to the fourth bend, shorter than the third leg, the fourth leg connected to the roller head.

In another variant, a neck for the paint roller, for connecting to a handle at a first end and to a roller at a second end, comprises: a first leg for connection to a handle; a first bend connected to the first leg having a first radius of curvature, redirecting the neck about 180 degrees from the first leg; a second leg connected to the second bend; a second bend having a radius of curvature smaller than the first radius of curvature, redirecting the neck about 90 degrees from the second leg; a third leg connected to the second bend; a third bend having a radius of curvature of about the same value as the third radius of curvature, redirecting the neck about 90 degrees from the third leg; and a fourth leg for connection to a paint roller connected to the third bend, the fourth leg connected to the roller head.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
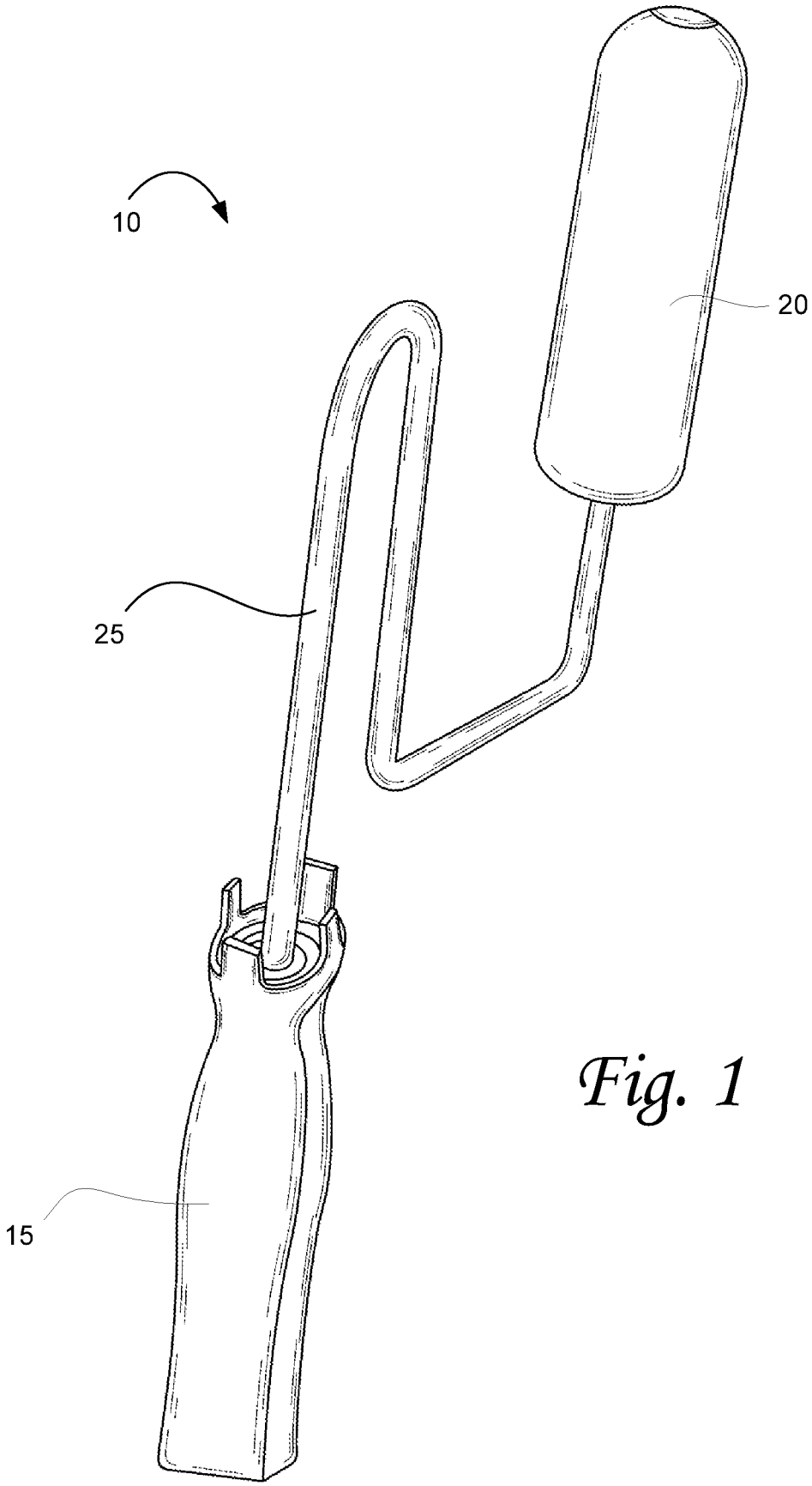
FIG. 1 is a perspective view of a paint roller in accordance with the principles of the invention.
Figure 2:
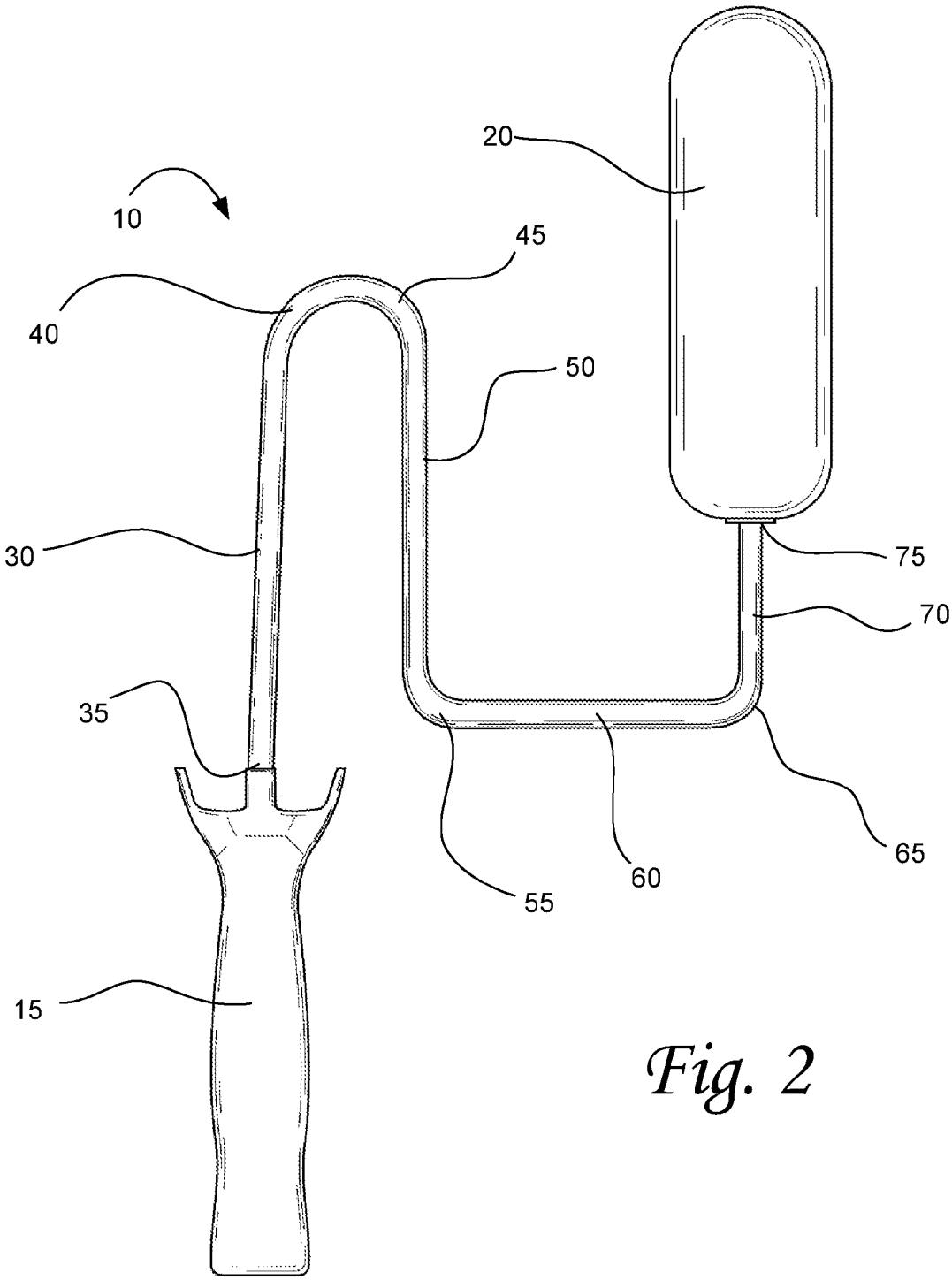
FIG. 2 is a right side view of the paint roller of FIG. 1.
Figure 3:
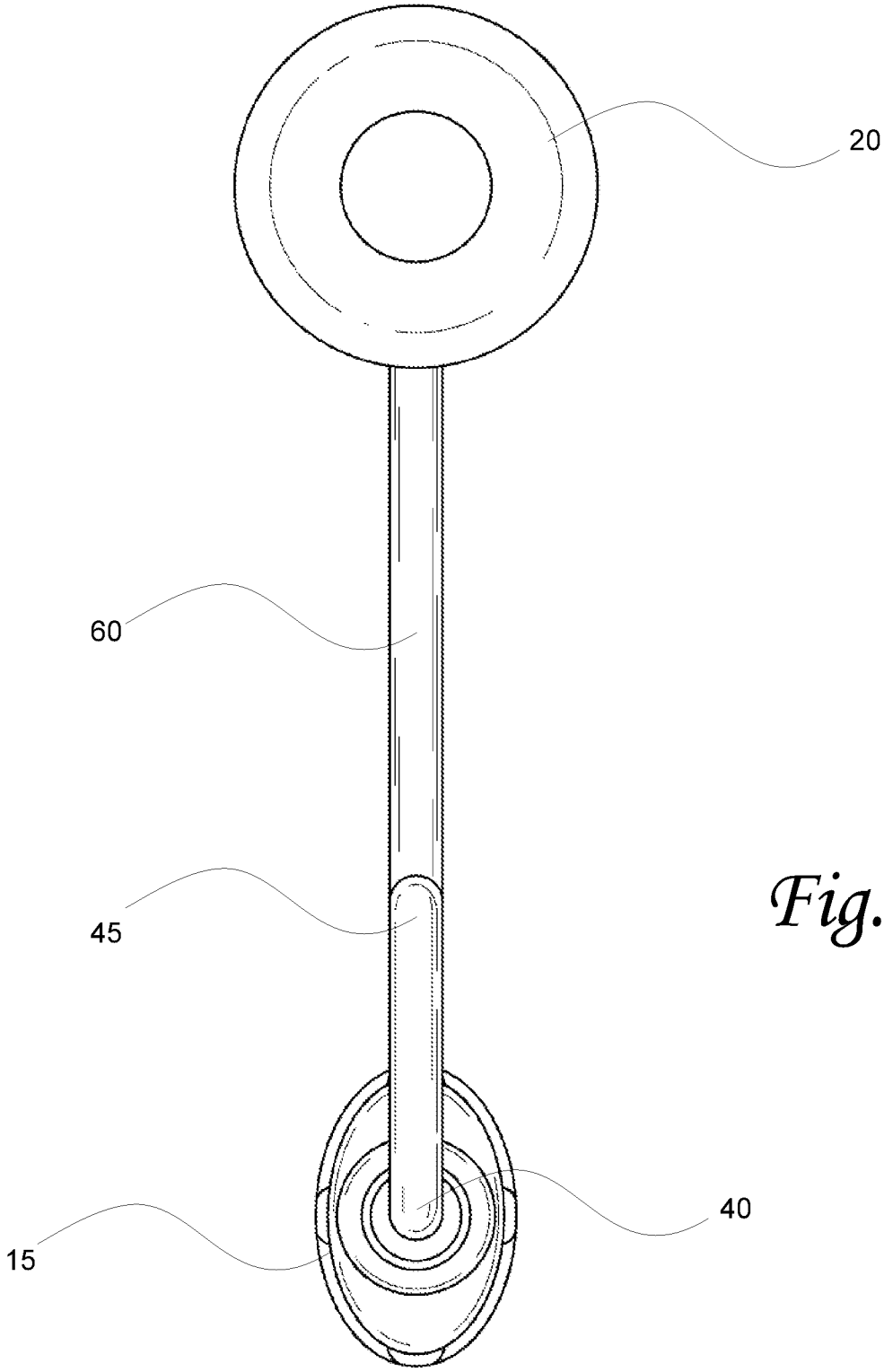
FIG. 3 is a top view of the paint roller of FIG. 2.
Figure 4:
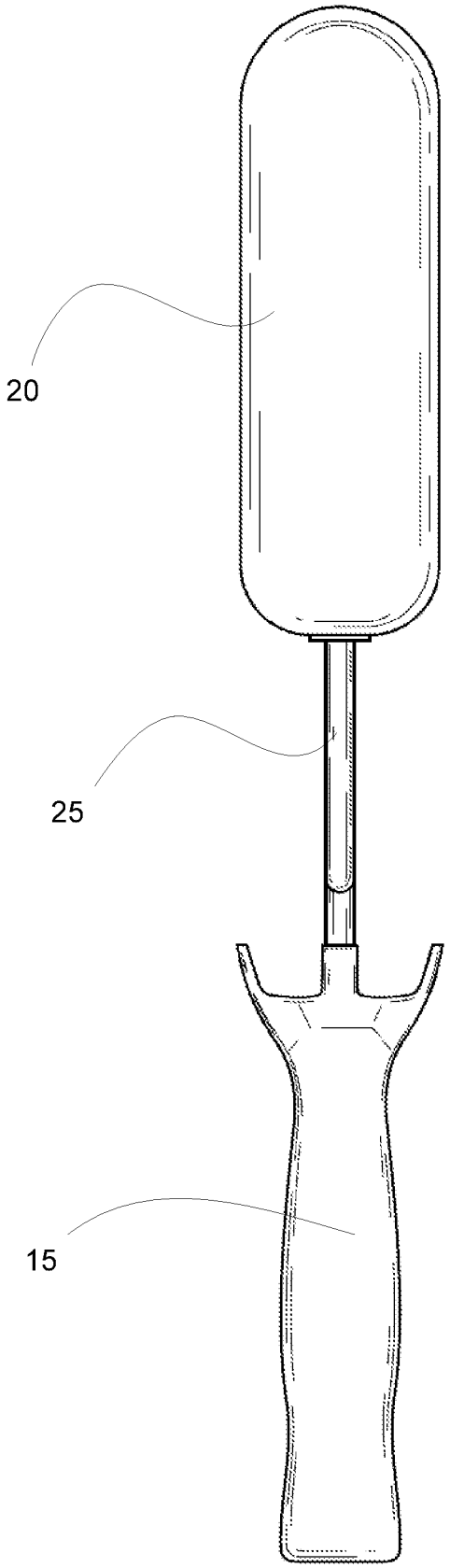
FIG. 4 is a front view of the paint roller of FIG. 2.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The following reference numbers are used in this document:

Paint roller 10
Handle 15
Roller head 20
Bevel 22
Neck 25
First leg 30
Angle 32
Top end of the handle 35
First bend 40, 42
Second bend 45
Second leg 50
Third bend 55
Third leg 60
Fourth bend 65
Fourth leg 70
Rotatable connection 75
Bottom of roller head 78

The present invention, in some embodiments thereof, relates to a paint roller 10 as shown in FIGS. 1-11. The paint roller 10 comprises: a handle 15, a roller head 20, and a neck 25.

Figure 8:
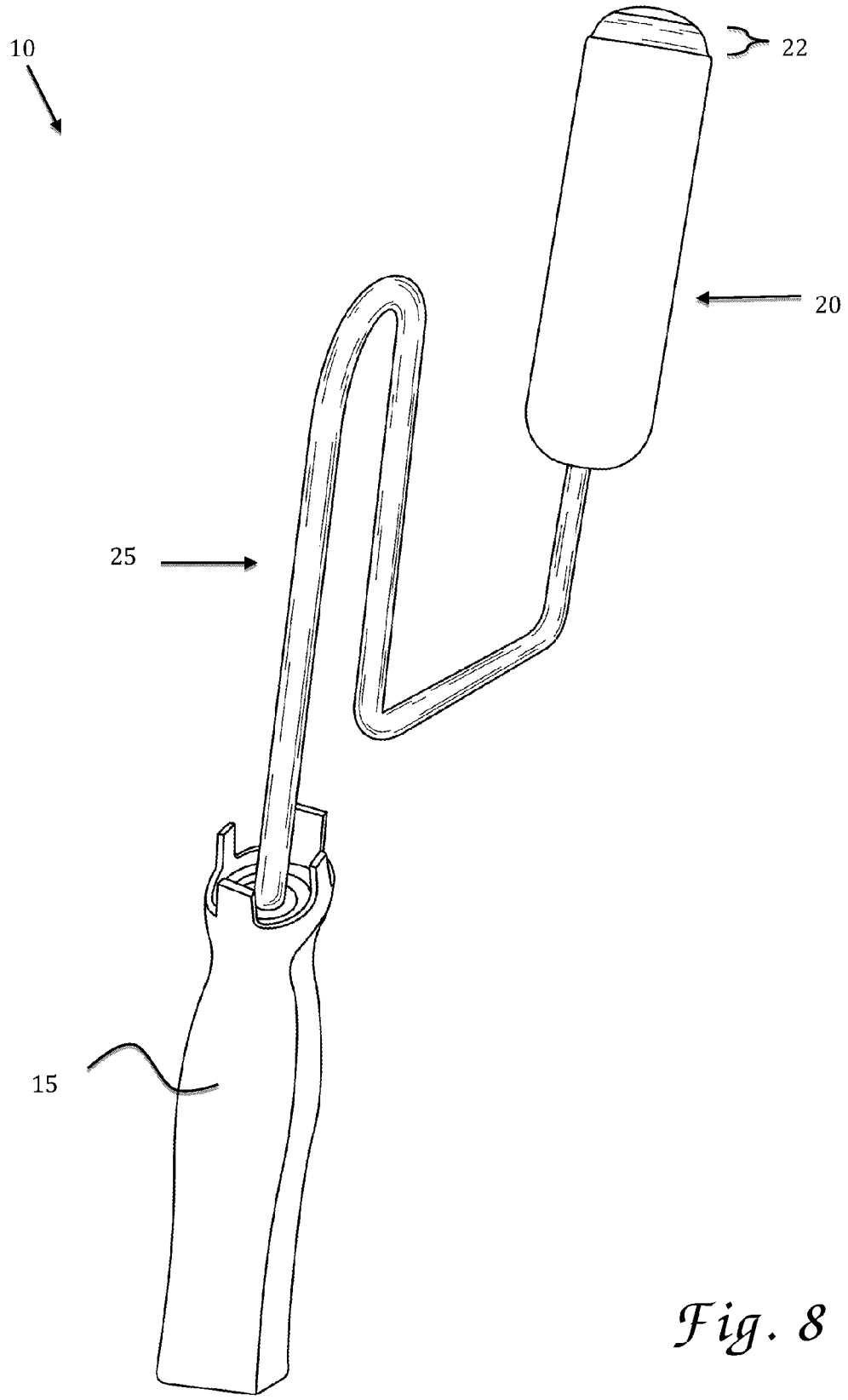
FIG. 8 is a perspective view of a paint roller, showing a bevel in the roller head.
Figure 9:
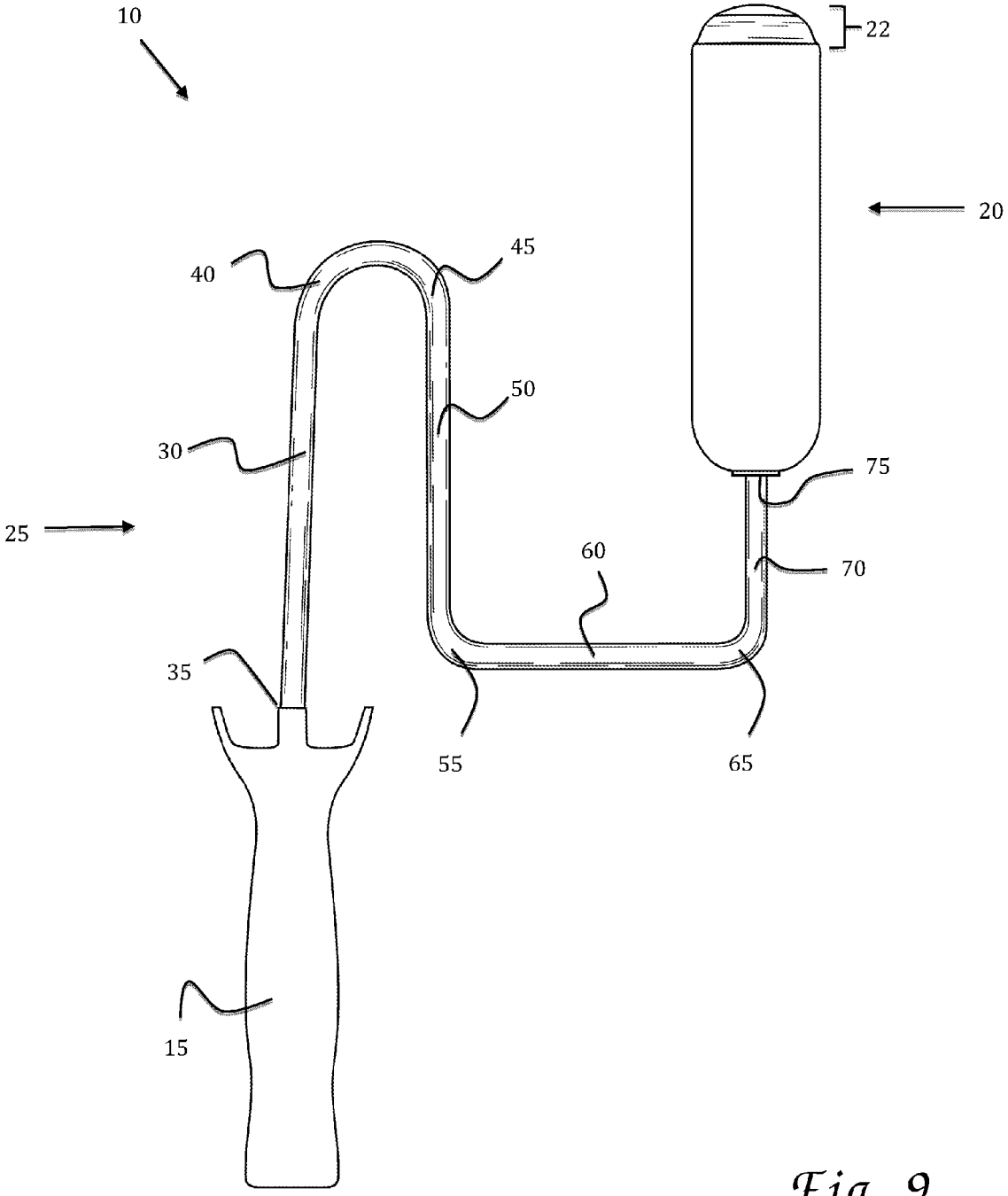
FIG. 9 is a right side view of the paint roller of FIG. 8.

In a variant shown in FIGS. 8-9, the roller head 20 may further comprise a bevel 22 that extends perpendicular to the circumference of the roller head 20. While the length of the bevel 22 may range from 1/20 of an inch to 1 inch, in the preferred embodiment, the bevel 22 is approximately 1/16 of an inch. The bevel 22 allows the roller head 20 to move into small spaces that are difficult to paint, such as ceiling corners.

Referring to FIGS. 2, 5, 9, and 11, the neck 25 connects the handle 15 to the roller 20, and the neck comprises a first leg 30 connected to the handle 15 and protrudes out from a top end 35 of the handle. A first bend 40 is connected to the first leg 30 and has a first radius of curvature, redirecting the neck about 90 degrees from the first leg 30. A second bend 45 has a second radius of curvature of about the same value as the first radius of curvature, and redirects the neck about 180 degrees from the first leg 30. A second leg 50 is connected to the second bend 45, and the second leg 50 is shorter than the first leg 30. A third bend 55 has a radius of curvature smaller than the first and second radii of curvature, and redirects the neck about 90 degrees from the second leg 50. A third leg 60 is connected to the third bend 55, and the third leg 60 shorter than the second leg 50. A fourth bend 65 has a radius of curvature of about the same value as the third radius of curvature, and redirects the neck about 90 degrees from the third leg 60. A fourth leg 70 is connected to the fourth bend 65, and is shorter than the third leg 60. The fourth leg 70 is connected to the roller head 20. The paint roller 10 has a rotatable connection 75 between the neck 25 and the roller head.

Figure 10:
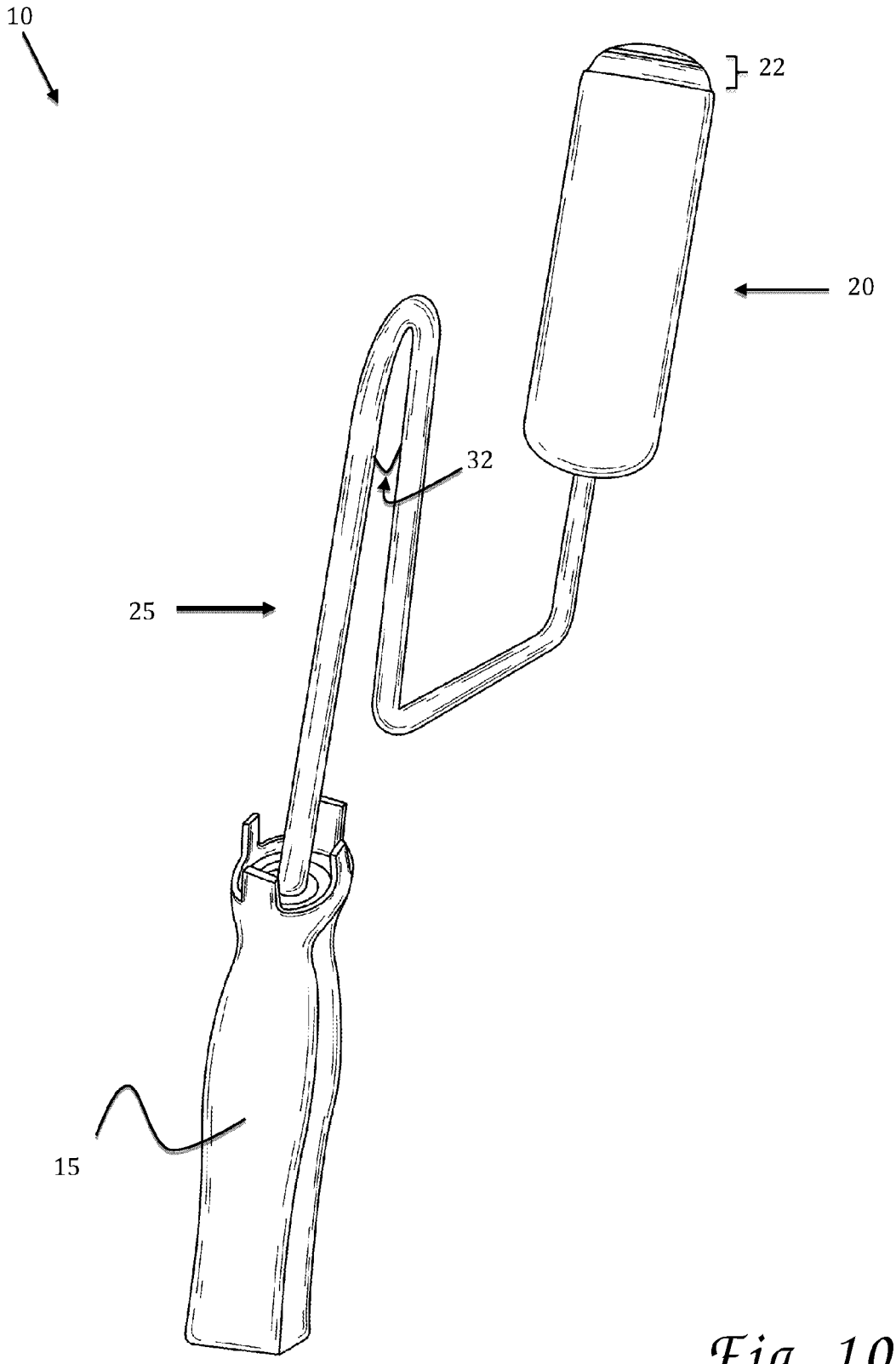
FIG. 10 is a perspective view of a paint roller, showing a bevel in the roller head and an angle between the first leg of the neck and the second leg of the neck.
Figure 11:
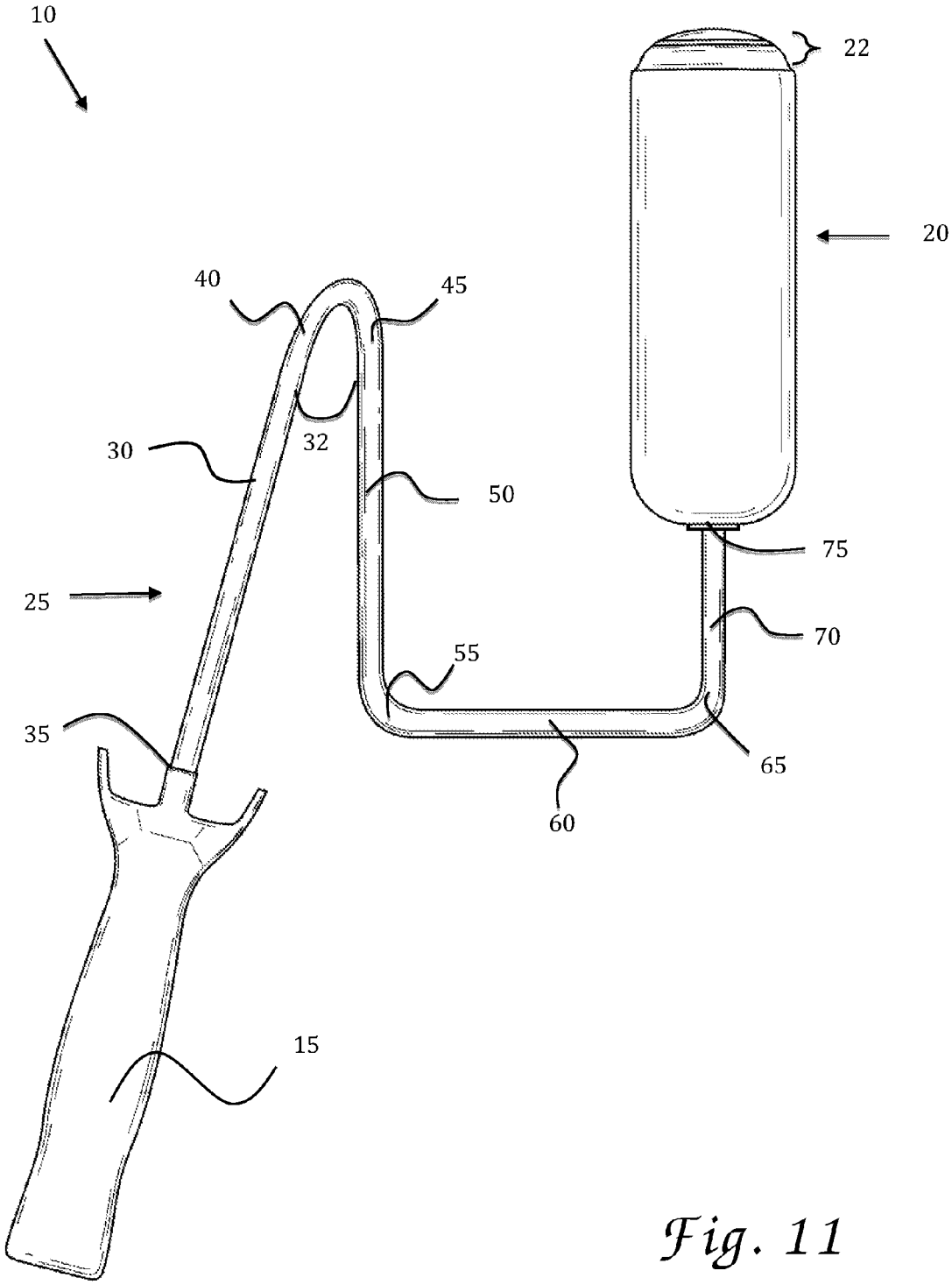
FIG. 11 is a right side view of the paint roller of FIG. 10.

In a variant shown in FIGS. 10-11, a paint roller may comprise a handle 15, a roller head 20, having a bevel that extends perpendicular to the circumference of the roller head 20, and a neck 25, further comprising a first leg 30 that makes an angle 32 with the second leg 50. While the angle 32 may range from 5 degrees to 25 degrees, angle 32 is 15 degrees in the preferred embodiment. This angle 32 allows the paint roller 10 to be easily maneuvered around objects and into small spaces.

Figure 5:
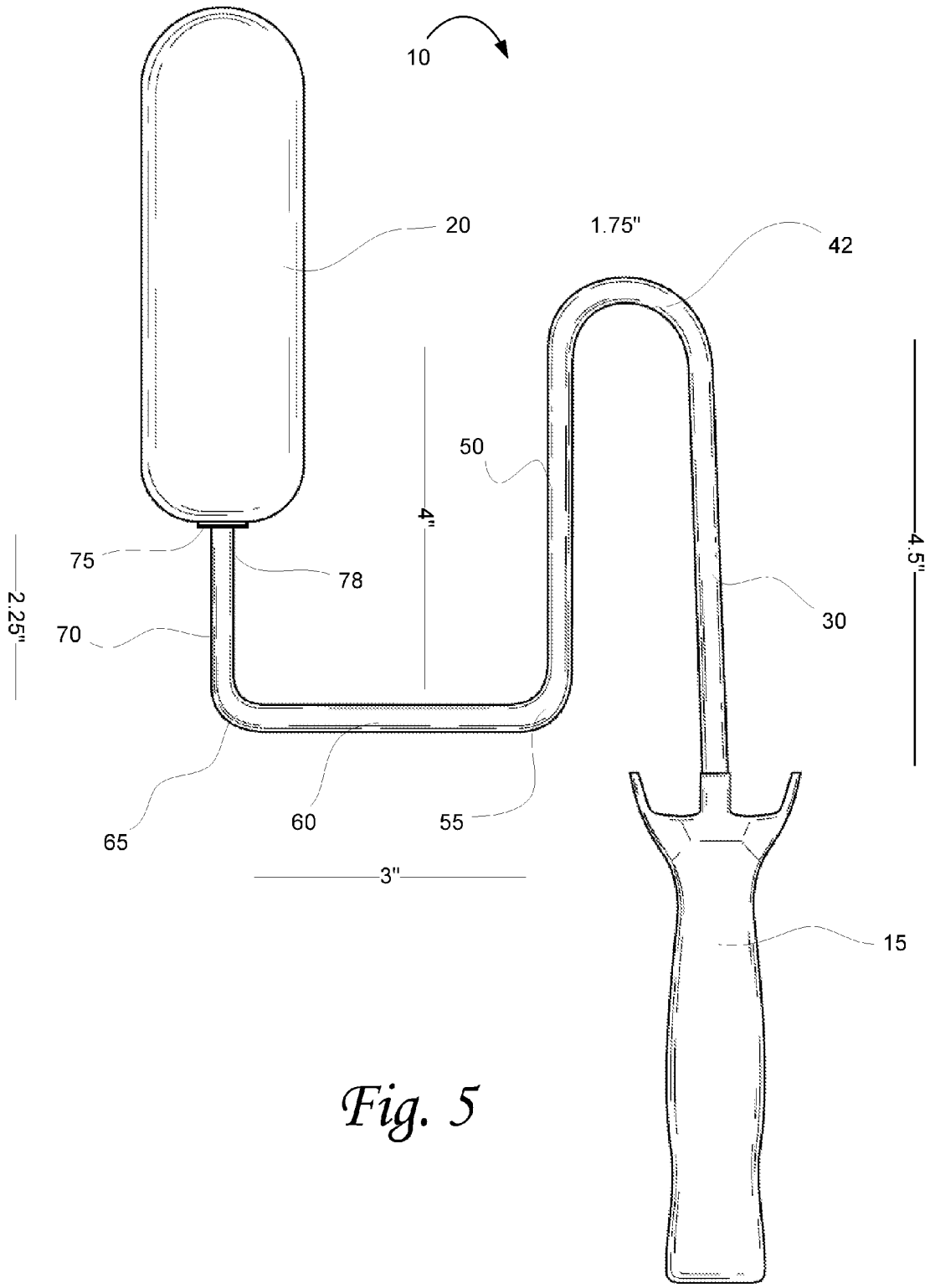
FIG. 5 is a left side view of the paint roller of FIG. 2.
Figure 6:
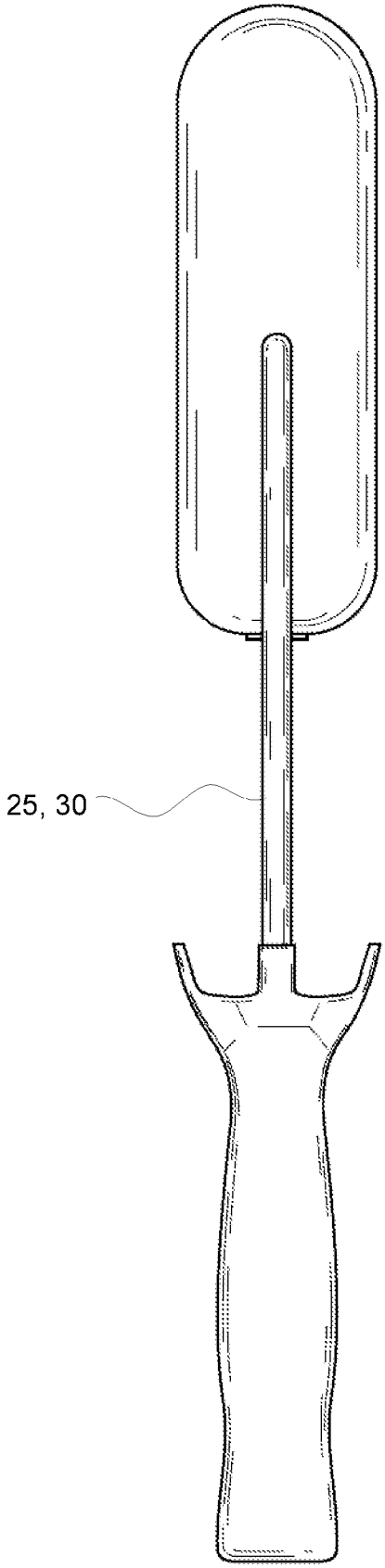
FIG. 6 is a rear view of the paint roller of FIG. 2.
Figure 7:
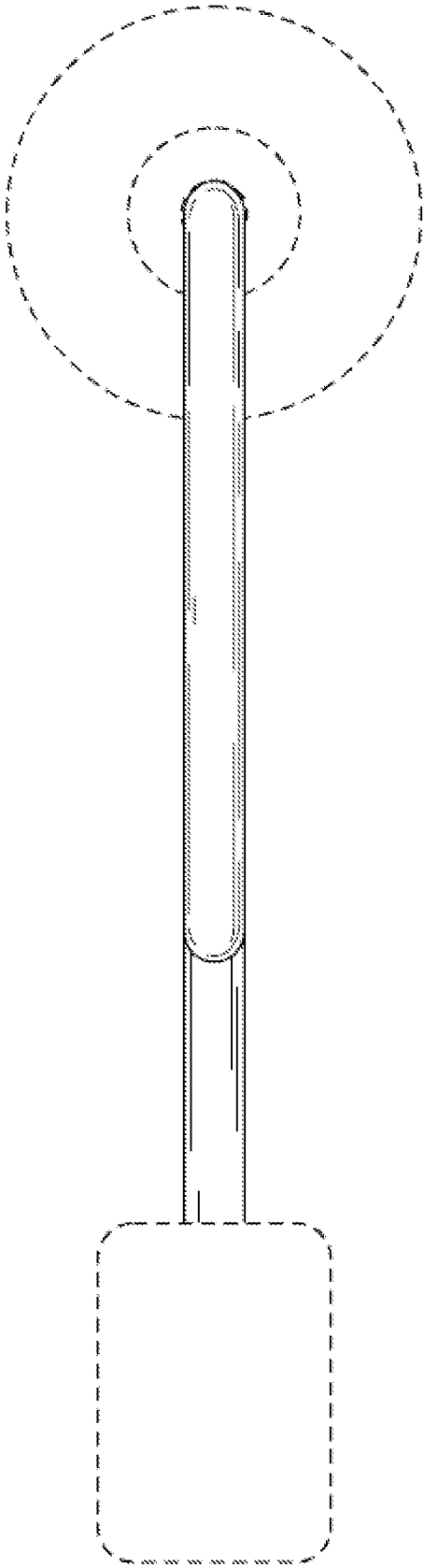
FIG. 7 is a bottom view of the paint roller of FIG. 2.

In another variant, referring to FIG. 5, a neck 25 for a paint roller 10, for connecting to a handle 15 at a first end 35 and to the bottom of roller at a second end 78, comprises a first leg of about 4.5 inches in length for connection to a handle 15. A first bend 42 is connected to the first leg 30 and has a first radius of curvature, redirecting the neck 25 about 180 degrees from the first leg 30 over a length of about 1.75 inches. A second leg 50 is connected to the first bend 42. A second bend 55 is connected to the second leg 50 and the second bend 55 has a radius of curvature smaller than the first radius of curvature, and redirects the neck 25 about 90 degrees from the second leg 50. A third leg 60 is connected to the second bend 55. A third bend 65 has a radius of curvature of about the same value as the second radius of curvature, and redirects the neck 25 about 90 degrees from the third leg 60. A fourth leg 70 for connection to a paint roller is connected to the third bend 65. The fourth leg 70 is connected to the roller head 20.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A paint roller, comprising:
- a handle;
- a roller head, comprising a bevel;
- a neck, connecting the handle to the roller, the neck comprising:
- a first leg connected to the handle and protruding out from a top end of the handle;
- a first bend connected to the first leg having a first radius of curvature, redirecting the neck about 90 degrees from the first leg;
- a second bend having a second radius of curvature of about the same value as the first radius of curvature, redirecting the neck about 180 degrees from the first leg;
- a second leg connected to the second bend, the second leg shorter than the first leg;
- a third bend having a radius of curvature smaller than the first and second radii of curvature, redirecting the neck about 90 degrees from the second leg;
- a third leg connected to the third bend, the third leg shorter than the second leg;
- a fourth bend having a radius of curvature of about the same value as the third radius of curvature, redirecting the neck about 90 degrees from the third leg;
- a fourth leg connected to the fourth bend, shorter than the third leg, the fourth leg connected to the roller head.

2. The paint roller of claim 1, wherein the first leg of the neck makes an angle to the second leg of the neck in the range of 5 to 25 degrees.

3. A paint roller, comprising:
- a handle;
- a roller head, having a bevel comprising a length in the range of 1/20 of an inch to 1 inch that extends perpendicular to the circumference of the roller head;
- a neck, connecting the handle to the roller, the neck comprising:
- a first leg connected to the handle and protruding out from a top end of the handle;
- a first bend connected to the first leg having a first radius of curvature, redirecting the neck about 90 degrees from the first leg;
- a second bend having a second radius of curvature of about the same value as the first radius of curvature, redirecting the neck about 180 degrees from the first leg;
- a second leg connected to the second bend, the second leg shorter than the first leg;
- a third bend having a radius of curvature smaller than the first and second radii of curvature, redirecting the neck about 90 degrees from the second leg;
- a third leg connected to the third bend, the third leg shorter than the second leg;
- a fourth bend having a radius of curvature of about the same value as the third radius of curvature, redirecting the neck about 90 degrees from the third leg;
- a fourth leg connected to the fourth bend, shorter than the third leg, the fourth leg connected to the roller head.

4. The paint roller of claim 3, wherein the first leg of the neck makes an angle to the second leg of the neck in the range of 5 to 25 degrees.

5. A paint roller, comprising:
- a handle;
- a roller head;
- a neck, connecting the handle to the roller, the neck comprising:

a first leg connected to the handle and protruding out from a top end of the handle;

a first bend connected to the first leg having a first radius of curvature, redirecting the neck about 90 degrees from the first leg;

a second bend having a second radius of curvature of about the same value as the first radius of curvature, redirecting the neck about 180 degrees from the first leg;

a second leg connected to the second bend, the second leg shorter than the first leg;

a third bend having a radius of curvature smaller than the first and second radii of curvature, redirecting the neck about 90 degrees from the second leg;

a third leg connected to the third bend, the third leg shorter than the second leg;

a fourth bend having a radius of curvature of about the same value as the third radius of curvature, redirecting the neck about 90 degrees from the third leg;

a fourth leg connected to the fourth bend, shorter than the third leg, the fourth leg connected to the roller head; and wherein the first leg of the neck makes an angle to the second leg of the neck in the range of 5 to 25 degrees.

* * * * *